US005465941A

United States Patent [19]

Abbott

[11] Patent Number: 5,465,941

[45] Date of Patent: Nov. 14, 1995

[54] FENCE SLAT LOCKING SYSTEM AND METHOD

[76] Inventor: Joshua B. Abbott, 10020 Portland Rd. N.E., Brooks, Oreg. 97305

[21] Appl. No.: 72,171

[22] Filed: Jun. 4, 1993

[51] Int. Cl.[6] ..... B21F 27/00

[52] U.S. Cl. ..... 256/34; 256/45

[58] Field of Search ..... 256/34, 45

[56] References Cited

U.S. PATENT DOCUMENTS

| | | | |
|---|---|---|---|
| 2,802,545 | 8/1957 | Rice | 256/45 |
| 3,069,142 | 12/1962 | Kessler | 256/34 |
| 3,572,640 | 3/1971 | Vecchiarelli | 256/34 |
| 3,712,590 | 1/1973 | Tochner et al. | 256/34 |
| 3,958,794 | 5/1976 | Suprunuk et al. | 256/34 |
| 4,085,954 | 4/1978 | Thompson | 256/34 |
| 4,512,556 | 4/1985 | Meglino | 256/34 |
| 4,570,906 | 2/1986 | Walden | 256/34 |
| 4,723,761 | 2/1988 | Cluff | 256/34 |
| 4,725,044 | 2/1988 | Cluff | 256/34 |
| 4,836,505 | 6/1989 | Meglino | 256/34 |
| 4,860,997 | 8/1989 | Schoenheit et al. | 256/34 |
| 4,950,088 | 8/1990 | Pipon et al. | 384/47 |
| 4,950,098 | 8/1990 | Abbott et al. | 403/34 |
| 4,995,591 | 2/1991 | Humphrey et al. | 256/34 |
| 5,056,761 | 10/1991 | Meglino et al. | 256/34 |
| 5,141,207 | 8/1992 | Meglino et al. | 256/33 |
| 5,165,664 | 11/1992 | Cluff | 256/34 |
| 5,234,199 | 8/1993 | Cluff | 256/34 |

*Primary Examiner*—Richard A. Bertsch
*Assistant Examiner*—William Wicker
*Attorney, Agent, or Firm*—Marger, Johnson, McCollom & Stolowitz

[57] ABSTRACT

A fence slat locking system includes elongated plastic slats weaved between consecutive links in a chain link fence. Each slat has a wall that is curved at the lateral sides. The bottom end of the slat is notched on opposite lateral sides defining a set of slat ears. A rail is weaved horizontally between the links of the chain link fence and attached with the bottom end of each slat. By inserting the bottom end of the slat vertically downward into a rail slot, the slat ears start to flatten moving the curved tips laterally away from the central longitudinal axis of the slat. Inserting the slat further vertically downward into the rail channel allow the slat ears to snap back into their original curved cross-sectional profile allowing the curved tips of the slat ears to snap back underneath a retaining section in the rail. The "snap back" action automatically locks the fence slat into the rail.

15 Claims, 5 Drawing Sheets

FENCE SLAT LOCKING SYSTEM AND METHOD

BACKGROUND OF THE INVENTION

This invention relates generally to slats that are inserted into a chain link fence and more particularly to a system for effectively locking the slats into the fence.

Chain link fences are inexpensive and are easy to install and maintain. Therefore, chain-link fences have become a popular way to secure portions of land. However, a chain link fence does not provide a high level of privacy and is generally not as attractive as, for example, a wood fence. Plastic slats are commonly weaved between the consecutive links of the chain-link fence to increase privacy, improve aesthetics, and provide wind protection. However, after the fence slats have been installed, they have a tendency to slip out of the chain link, causing the slats to become misaligned and reducing the overall effectiveness of the slats in increasing fence security and aesthetic beauty. Traditional fence slats can also be easily removed by vandals. Having to continuously realign fence slats due to slippage or replace fence slats due to vandalism negate the major advantages for installing a chain link fence, namely, low cost and low maintenance.

Numerous techniques have been devised to maintain alignment of the slats and impede unauthorized attempts to remove the slats. For example, U.S. Pat. No. 4,725,044 to Cluff and U.S. Pat. No. 4,723,761 to Cluff use a multitude of clips to secure the fence slats in the fence fabric. The clips, however, increase the number of parts and the amount of time required to install the fence system.

Other techniques such as U.S. Pat. No. 3,572,640 to Vecchiarelli and U.S. Pat. No. 3,958,794 to Suprunuk et al. provide special bends at the slats ends that are used to attach the slat to the fence. Special bends at the ends of the slats increase manufacturing costs and prevent efficient stacking of the slats, thus, increasing shipping costs.

U.S. Pat. No. 4,085,958 to Thompson and U.S. Pat. No. 4,570,906 to Walden disclose slats that provide a second horizontal retainer that is used to seat vertically aligned slats. The slats and the retainer, however, do not interlock and, therefore, would not prevent unauthorized removal of the fence slats from the chain link fence. U.S. Pat. No. 4,950,098 to Abbott, et al. uses a retaining section that attaches to a slot at the end of the fence slat. The slot is cut into the center of the slat and is bent out to engage with the retaining section.

U.S. Pat. No. 5,165,664 to Cluff uses a horizontally aligned clip that attaches to barbs placed on opposite lateral ends of the slat. The slat barbs, however, only attach with a small section of the retainer. A small slat/retainer contact area make it highly likely that the slat will not always seat properly in the retainer. The slats are, therefore, subject to unauthorized removal when the retainer is not properly engaged. Having to constantly reinsert the slat into the clip until the system properly locks increases overall installation time. Because, the retainer only attaches with a small section of the slat barb, it is difficult to determine with a high degree of confidence whether the slat actually seats properly in the retainer. For example, there is not a loud "snap" when the slat locks into the retainer. Thus, there is a greater chance that slat system will be improperly installed.

Several of the slats described above have rounded lateral sides or tubular designs. These rounded sides prevent the slats from being efficiently stacked for shipping and storage.

Rounded sides also restrict slat width. For example, the slats cannot extend as far laterally in between the interlocking links of the chain link fence. Thus, a wider spacing exists between adjacent slats, reducing the amount of privacy provided by the slats and increasing the amount of distance the slat can shift in between the chain links. Several of the previous slat systems described above also require a fairly high degree of accuracy in the dimensional relationships between the retaining section and the slat. For example, in Cluff, the barbs must be cut at a precise location on the bottom end of the slat or the clip will not lock correctly. Thus, more time must be spent in tooling and manufacturing to ensure each slat and clip operates satisfactory.

Accordingly, a need remains for a low cost slat locking system that can be quickly and reliably installed in a chain link fence and is more effective in preventing unauthorized slat removal.

SUMMARY OF THE INVENTION

It is, therefore, an object of the invention to reduce the cost of manufacturing and shipping locking fence slats.

Another object of the invention is to reduce the complexity of fence slat locking systems and to simplify the procedure for installing the system into a fence.

A further object of the invention is to reduce the chances of fence slats becoming misaligned and vandalously removed from a fence after initial installation.

The invention is a fence slat locking system that incorporates desirable features of longevity, appearance, and effectiveness of locking ability and is also easy to make, store, ship, and install to reduce manufacturing, distribution, and installation costs.

In a first embodiment of the invention, the fence slat locking system includes elongated plastic slats that are weaved vertically between consecutive links in a chain link fence. Each slat comprises a single wall having a curved cross-sectional shape. The bottom end of the slat is notched on opposite lateral sides defining a set of ears. A rail is weaved horizontally between the links at the bottom of the chain link fence and attaches with the bottom end of each slat. The rail has a fastening wall, a support wall, and a retaining section. The fastening wall and the support wall are coupled together at the bottom edges by a base section to form a rail channel and the retaining section is coupled to the top edge of the fastening wall and extends into the rail channel.

By inserting the first end of the slat vertically downward between the support wall and the retaining section, the slat ears start to flatten moving the curved tips laterally away from a central longitudinal slat axis. Inserting the slat vertically downward further into the rail channel allow the slat ears to snap back into their original shape allowing the curved tips of the slat ears to slide underneath the retaining section. The "snap back" action automatically seats the retaining section into the slat notches and indicates that the slat is properly installed. The arched shape of the slat causes the slat to press outward against the chain links securely holding the slat in the fence. The slat elasticity also allow recovery of the slat ears into their original curved shape after insertion into the rail channel. Each notch has a unique oppositely inclining upper edge that meets with a horizontally directed lower edge that provides effective locking with the rail even with minor variations in manufacturing tolerances.

In an alternative embodiment of the single walled slat, the slat comprises a single substantially flat elongate wall with oppositely inclined lateral side walls extending outward away from the central longitudinal axis of the slat. A set of notches can also be cut on opposite lateral sides of the top end of each slat. A rail can then be inserted horizontally between the links in the chain links at the top of the fence for attaching to the top end of the slats. In a tubular embodiment of the slat, each slat comprises front and back elongated walls spaced apart by a pair of rounded lateral side walls to form a substantially hollow, flat, tubular shape. Each notch passes through one of the lateral edges and symmetrically through both the front and back wall. By inserting the first end of the slat into the rail, the front and back walls of the slat ears are pressed toward each other allowing the slat ears to pass into the rail channel. Inserting the first end of the slat further into the rail channel allow the front and back walls to elastically regain their original spaced apart distance locking the slat into the rail channel. The lateral edges of the slats below the notches can be cut to provide a first and second set of oppositely opposed slat ears that can be attached over opposite sides of the rail fastening wall.

One embodiment of the rail is a support wall that extends vertically up from a curved bottom and is flared slightly outward at its top end to facilitate easy entry of the slat tip. An attachment wall connects to the opposite end of the curved bottom and extends upward forming a rail channel. A retaining section is coupled to the top of the attachment wall and curves upward and away from the rail channel to facilitate easy slat insertion. The channel area provides a confined channel slot at the top of the rail. By inserting the bottom end of the slat into the rail channel slot the ears on the bottom end of the slat flatten. As the slat ears are inserted further into the wider slat channel, the slat ears expand to their normal curvature engaging with the lower end of the retaining section locking the slat and the clip together.

A second embodiment of the clip has a vertically aligned support wall and a vertically aligned fastening wall both coupled at the bottom edge by a horizontally aligned base to provide a rectangular shaped rail channel. A retaining section is coupled to the top of the fastening wall protruding into the rail channel to provide restricted slat entry into the rail channel as discussed above. The top ends of the support wall and the fastening wall each include lips that protrude up and away from the rail cavity to facilitate slat insertion.

The foregoing and other objects, features and advantages of the invention will become more readily apparent from the following detailed description of the preferred embodiment which proceeds with reference to the drawings.

DETAILED DESCRIPTION

Figure 1:
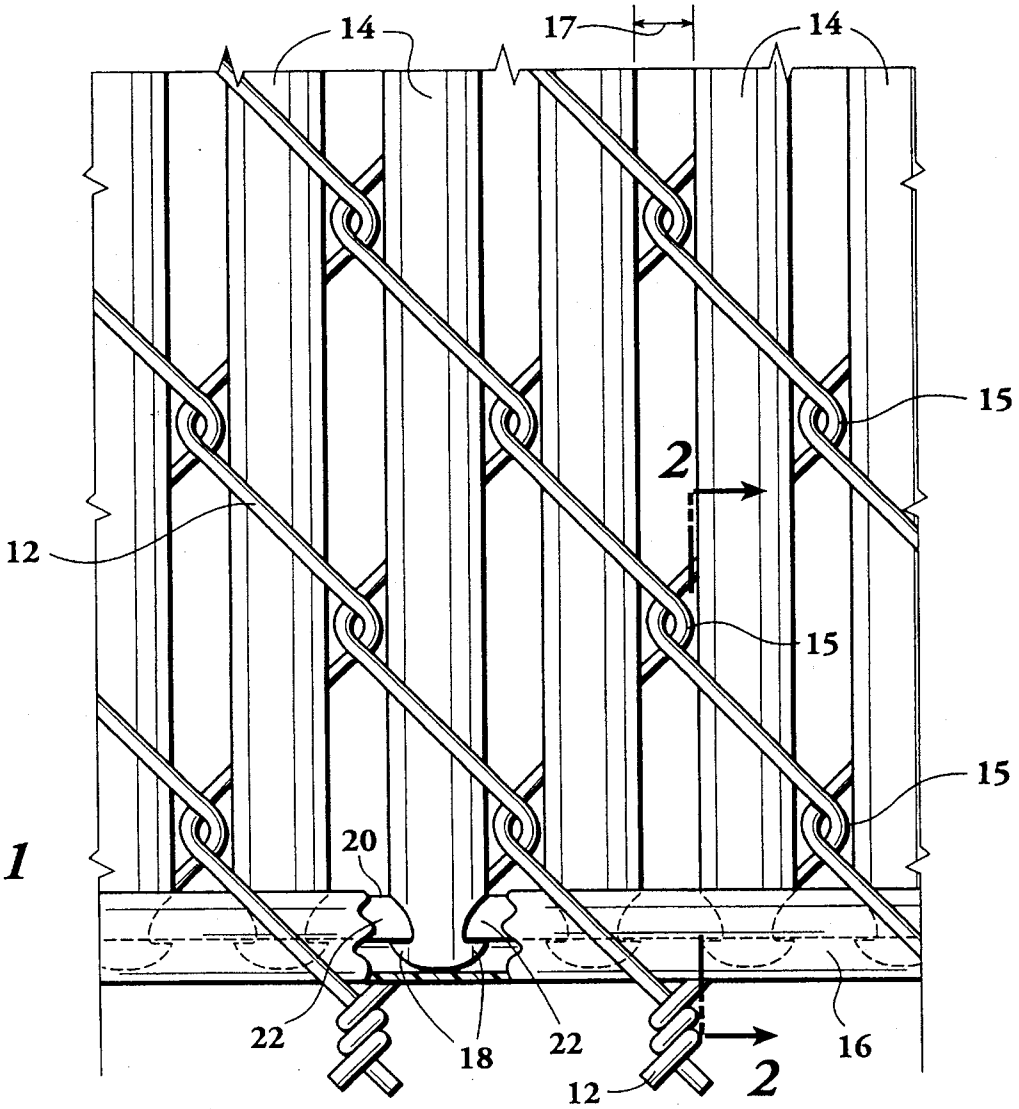
FIG. 1 is a front view of a fence slat locking system according to the invention.

FIG. 1 is a front view of a fence slat locking system according to the invention. A chain link fence 12 has consecutive links 15 that are supported above the ground by support poles (not shown). Multiple fence slats 14 are weaved between the consecutive links in the chain link fence 12. A rail 16 is weaved horizontally between the bottom links of the chain link fence 12 and attaches with the bottom end of each slat 14. The bottom end of each slat 14 has notches 22 located on opposite lateral sides. The lateral sides of each slat extending between the notches 22 and the bottom end of slat 14 defining a set of slat ears 18.

The slats 14 are precut to match the standing height of the chain link fence 12 and have a curved cross-sectional profile of predetermined length to occupy as much of the interior space as possible between horizontally adjacent links. Occupying as much in between the chain links minimizes the distance between adjacent fence slats 60 providing optimal privacy and maximizes wind protection. Occupying maximum space between adjacent chain links also minimize side-to-side and back-and-forth slat movement. Each slat has a rounded bottom end keeping the slat from hanging up on the link wires 12 during installation.

Figure 2:
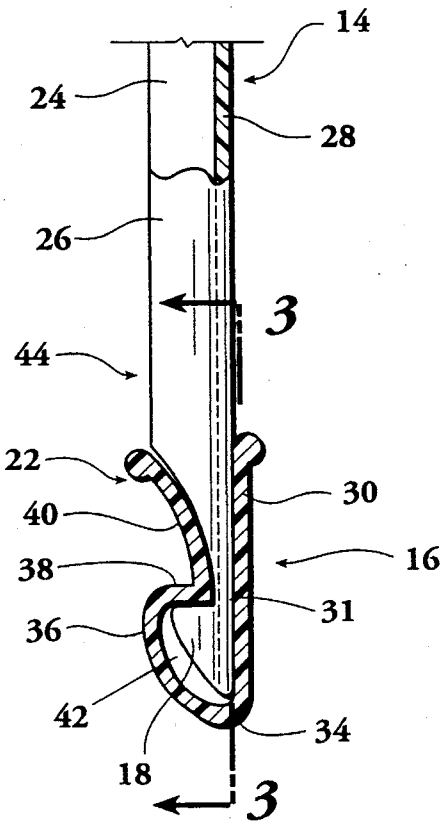
FIG. 2 is a side sectional view of the fence slat locking system shown in FIG. 1.

FIG. 2 is a side sectional view of the fence slat locking system shown in FIG. 1. The slat 14 comprises a rounded back section 28 having a set of curved lateral sides 24 and 26. The rail 16 attaches to the bottom end of each slat and includes a fastening wall 36, a support wall 30, and a retaining section 40. The fastening wall 36 and the support wall 30 are coupled together at the bottom edges by a rounded base section 34 to form a channel 42. A retaining section 40 is attached by a horizontally aligned section 38 to the top edge of the fastening wall 36 to form a rail slot 44. The retaining section 40 extends up and away from the rail channel 42.

The entire length of support wall 30 lies against the back side of slat 14 keeping the slat aligned and firmly pressed underneath retaining section 40. Thus, the support wall 30 keep slat 14 from being easily dislodged from the rail 16 by someone either twisting or rotating the slat. The support wall 30, typically, extends above the top of notches 22 to improve the aesthetic beauty of the locking system at the bottom of the chain link fence 12. For example, when looking at the front of the locking system (FIG. 1), the front side of the support wall 30 hide the bottom end of slat 14. The fastening wall 36 conforms with the natural rounded tips of slat ears 18 and the retaining section 40 conforms with the natural curvature of slot 22.

One unique feature of slat 14 are notches 22. Since the notches 22 have been cut in the sides of the slat 14, they create an apparent reduction in slat thickness just above the slat tips 18. Thus, inserting the bottom end of the slat 14 vertically downward between the support wall 30 and the retaining section 40, flatten the slat ears 18 moving the curved tips laterally away from the central longitudinal axis of the slat 14. Inserting the slat further vertically downward into the wider rail channel 42 allow the slat ears 18 to regain their original curved profile causing the curved tips of the slat ears to slide underneath the retaining section 40 automatically seating the retaining section 40 into the notches 22. The slat 14 is now secure from slipping and is resistent from casual removal by a vandal. Slats are removed by displacing the rail 16 laterally freeing the slat ears from the rail channel.

Rail 16 is generally installed horizontally in the bottom of the chain link fence 12 (see FIG. 1) with the slot channel 44 opening upwards. However, the rail 16 may also be located at the top of the fence, the rail channel 42 directed downwards. The notches 22 are then placed at the top of the slat and the slats are locked into rail 16 by pushing the slat up into the rail channel 42.

Figure 3:
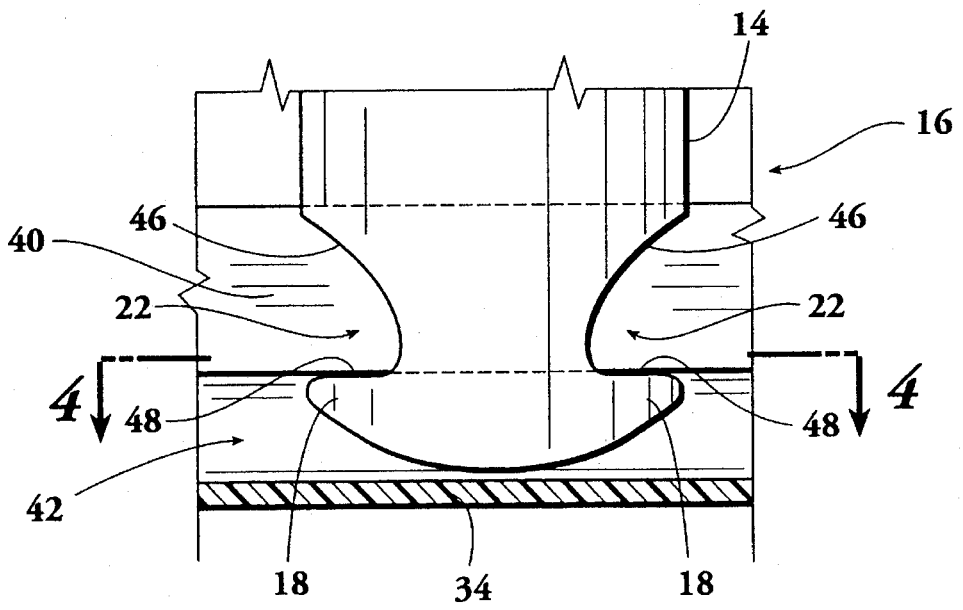
FIG. 3 is a front sectional view of the fence slat locking system shown in FIG. 1.

FIG. 3 is a front sectional view of the fence slat 14 and rail 16 shown in FIG. 1. The notches 22 comprise oppositely inclining upper edges 46 meeting with horizontally directed lower edges 48. The horizontally directed lower edge 48 engages with retaining section 40 preventing the slat ears 18 from being removed vertically upward from the rail 16. The upper edges 46 are cut to follow the same general contour of retaining section 40. Thus, retaining section 40 contacts a significant portion of upper edge 46 holding the slat 14 firmly in rail 16. It is important to note that the slot and rail design provide effective locking even with minor variances in manufacturing tolerances. For example, the notches 22 can be cut slightly higher or lower on the bottom end of slat 14 and still effectively lock into rail 16. Thus, less time is required in cutting notches 22 and the number of fence slats that are defectively manufactured is reduced.

Figure 4:
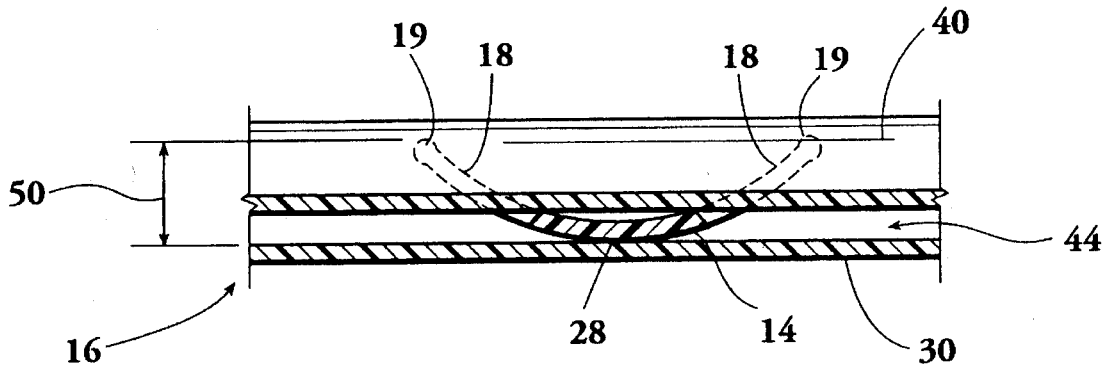
FIG. 4 is a top sectional view of the fence slat locking system shown in FIG. 1.

FIG. 4 is a top sectional view of the fence slat locking system shown in FIG. 1. The slat 14 comprises a single wall having an arched cross-sectional shape and a given amount of elasticity. The elasticity of slat 14 allow it to be deformed or "flattened" for insertion between the chain links. The slat 14 then partially recovers from the deformed shape after insertion so that the front and back sides of the slat press against the inside of the chain links securely holding the slat 14 in the chain link fence 12 (FIG. 1). It is important to also note that the arched cross-sectional shape of the slat allow it to extend further laterally against adjacent links in the chain link fence than many previous slat configurations. For example, the narrow tips 19 of slat 14 can press directly against horizontally adjacent links 15 (see FIG. 1) reducing the space between adjacent slats. Reducing the space between slats increases privacy and wind protection.

The elasticity of slat 14 also allows the slat ears 18 to recover into their original curved cross-sectional shape after slat 14 has been completely inserted into the rail 16. For example, as previously shown in FIG. 2 and also shown in FIG. 4, the width of rail slot 44 (i.e., the distance from retaining section 40 and support section 30) is significantly narrower than the cross-sectional width 50 of slat 14. Thus, as the bottom end of slat 14 is inserted into rail slot 44 the slat ears 18 flatten moving away from the center longitudinal axis of slat 14.

As shown in FIG. 2, the width of channel 42 (i.e., the distance from fastening wall 36 to support wall 30) is wider than the cross-sectional width 50 of slat 14. Thus, as the bottom end of the slat 14 is pressed further down into rail channel 42, the slat ears 18 "snap" back into their original curved shape moving underneath retaining section 40 locking the slat inside the rail 16. The substantial deformation of the slat ears 18 and then the elastic reformation of the slat ears back into their original curved configuration, after moving into the rail channel 42, create a substantial "snapping" noise. This "snap" is an indicator during installation that the fence slat 14 is effectively locked into rail 16. Thus, the "snapping" noise serves as a confirmation that the slat has been correctly installed.

Figure 5A:
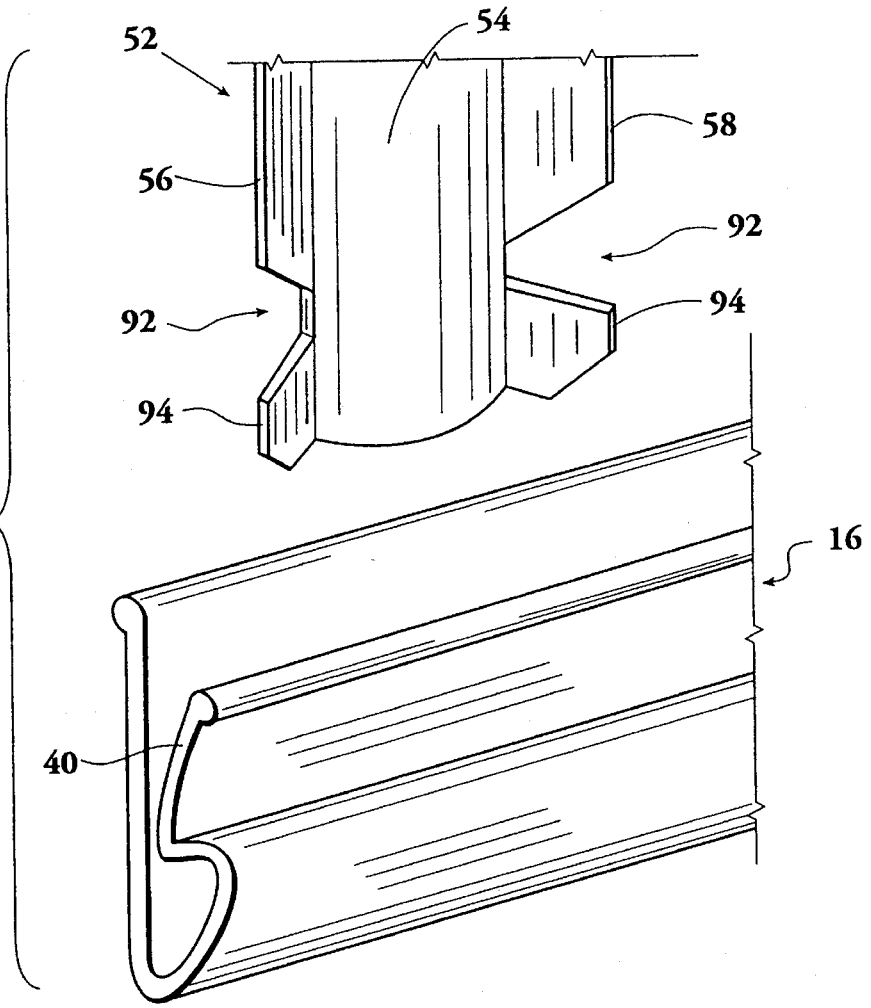
FIGS. 5A and 5B are prospective views of an alternative embodiment of a single walled fence slat according to the invention.
Figure 5B:
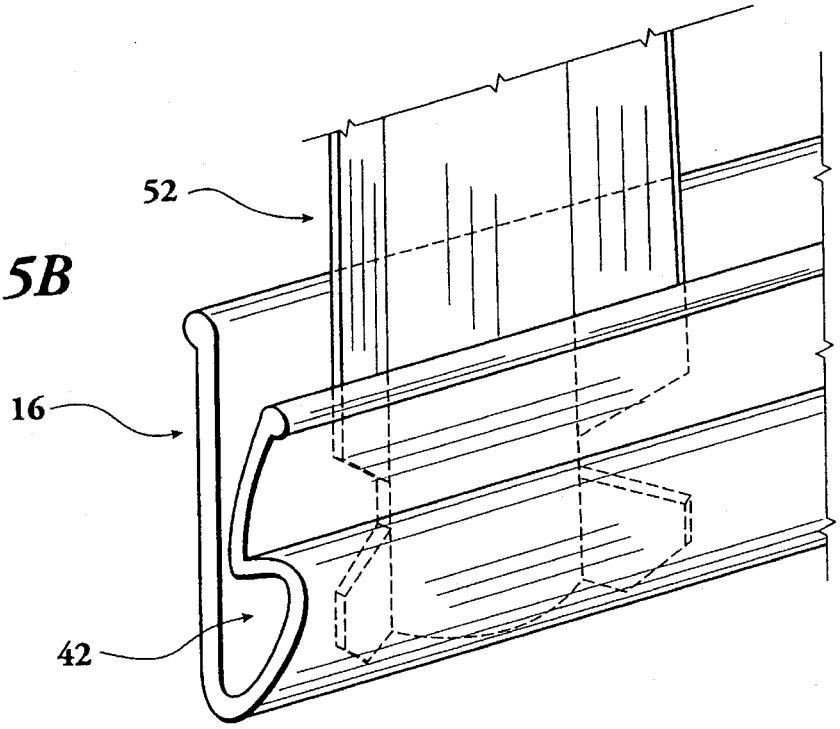

Several alternative single walled slat designs can provide substantially the same locking characteristics and effective slat coverage in the chain link fence as described above. For example, FIGS. 5A and 5B are perspective views of an alternative embodiment of a single-wall fence slat 52 according to the invention. A slat 52 comprises a single substantially fiat elongate wall 54 with oppositely inclined lateral side walls 56 and 58 extending outward away from the central longitudinal axis of slat 52.

The bottom of slat 52 includes notches 92 similar to those cut into slat 14 ( FIG. 1). The notches form slat ears 94 at the bottom end of slat 52 similar to slat ears 18 shown in FIG. 1. The notches are again cut to conform with the shape of retaining section 40. As the bottom of slat 52 is inserted into the rail 16 the slat ears 94 spread out. As the bottom end of slat 52 moves into the rail channel, the slat ears regain their original cross-sectional shape as shown in FIG. 5. Thus, the slat ears snap into the rail channel 42 locking the slat 52 to the rail 16.

Figure 6:
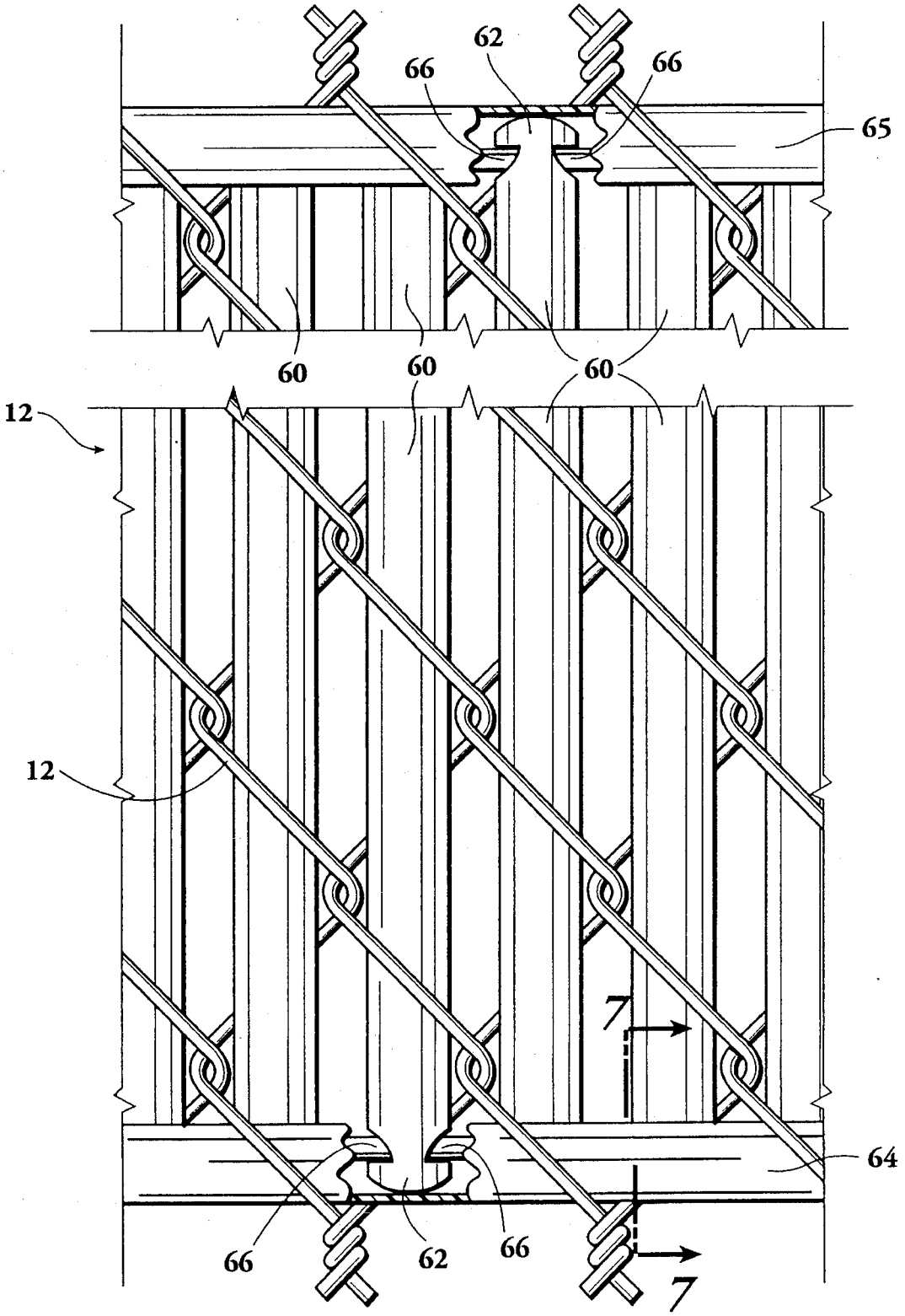
FIG. 6 is a tubular slat locking system according to another embodiment of the invention.
Figure 7:
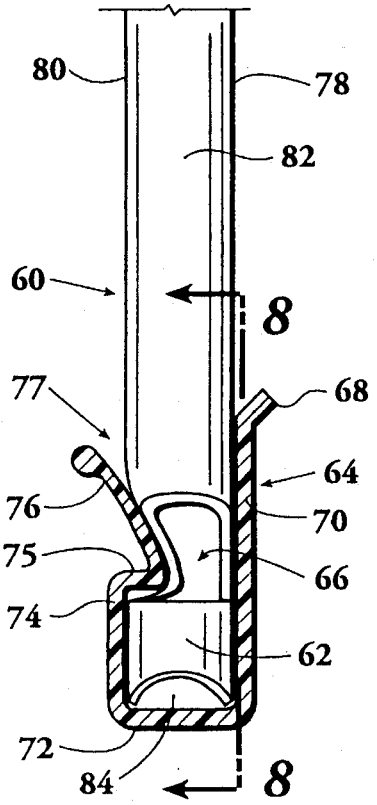
FIG. 7 is a side sectional view of the locking system shown in FIG. 6.

FIG. 6 is a front view of a tubular slat locking system according to another embodiment of the invention. A tubular slat 60 is interweaved vertically though the same chain link fence 12 previously shown in FIG. 1. The tubular slat 60 has a pair of upper and lower notches 66 at the top and bottom end that interlock with a upper and lower rail 64, respectively. FIG. 7 is a side sectional view of the tubular fence slate 60 and rail 64 shown in FIG. 6. Each fence slat 60 includes a front wall 78 and a back wall 80 spaced apart by a pair of rounded lateral sides 82 to form a substantially hollow, fiat, tubular shape (see FIG. 9 below for further description). Rail 64 is an alternative embodiment of the invention that can also be used with the single-wall fence slats previously shown in FIGS. 1 and 5. Rail 64 includes a vertically aligned support wall 70 and a vertically aligned fastening wall 74 coupled at the bottom edge by a horizontally aligned base 72 providing a rectangular shaped rail channel 84. A diagonally aligned retaining section 76 is coupled to the top end of the fastening wall 74 by a section 75. A lip 68 is connected at the top of support wall 70.

The retaining section 76 extends into rail cavity 84 providing a narrow rail slot 77. As the bottom end of slat 60 is inserted into the rail slot 77, the front wall 78 and the back wall 80 of the slat ears 62 are pressed toward each other. At the same time, the support wall 70 and the fastening wall 74 slightly expand. The reduced cross-sectional width of the slat ears 62 and the increased rail slot width, allow the slat ears 62 to pass into the rail channel 84.

Inserting the bottom end of the slat 60 further into the rail channel 84 allow the slat ears 62 to elastically reform so that the front and back walls 78 and 80, respectively, regain their original spaced apart distance. When the slat 60 is completely seated in rail 64, retaining section 76 is positioned over a narrow section 67 of back wall 80 (see FIG. 8) between notches 66. This narrow section of the back wall is less resistent to bending and allows the retaining section 76 to deform the back wall toward front wall 78 without significantly altering the original distance between the front and back walls of the slat ears 62. Thus, the slat ears seat underneath retaining section 76 locking the slat 60 to rail 64.

Figure 9:
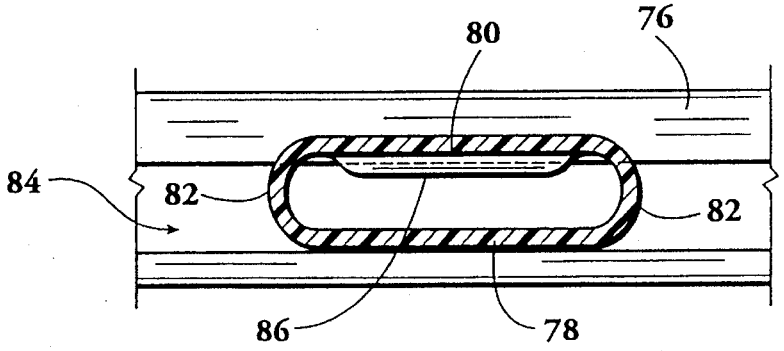
FIG. 9 is a top sectional view of the locking system shown in FIG. 6.
Figure 8:
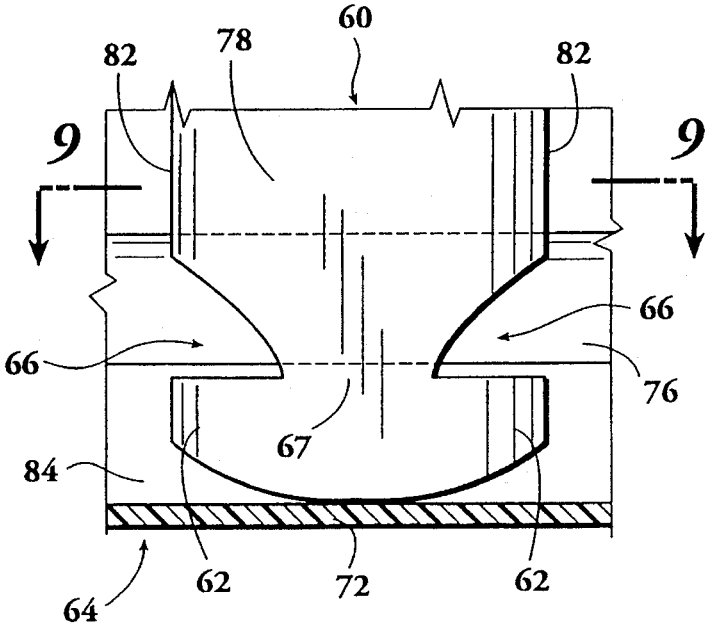
FIG. 8 is a front sectional view of the locking system shown in FIG. 6.

FIG. 8 is a front sectional view of the locking system shown in FIG. 6 and FIG. 9 is a top sectional view of the fence slat locking system shown in FIG. 6. Each notch 66 passes through an opposite lateral edge 82 and passes symmetrically through both the front wall 78 and the back wall 80 (see FIG. 7). As described above, notches 66 narrow the width of the front and back walls 78 and 80 and remove a section of the lateral edges 82. Thus, the slat area between the notches 66 is easier to deform. Retaining section 76 can then continuously press the back slat wall section 86 (FIG. 9) closer to front wall 78 while allowing the distance between the front and back walls of the slat ears 62 to maintain their original spaced apart distance.

In summary, the cross-sectional shape of the slats as shown in FIGS. 1 and 5, are capable of being laid down horizontally and stacked on top of each other in a highly compacted manner reducing the cost of shipping and storage. The simple interlocking design uses only two pieces (i.e., fence slat and rail) to effectively lock the fence slats into a chain link fence. The foolproof installation procedure that produces a snapping sound when the slat is properly locked in the rail assures the slat locking system is installed correctly. The wide notches allow the interlocking design to work effectively over a wider range of manufacturing tolerances. The interlocking sections of the slat and the rail provide improved aesthetics and longevity since each slat can be wider reducing the distance between adjacent slats in the chain link fence.

Having described and illustrated the principles of the invention in a preferred embodiment thereof, it should be apparent that the invention can be modified in arrangement and detail without departing from such principles.

I claim all modifications and variation coming within the spirit and scope of the following claims:

1. A system for locking slats into a chain link fence, comprising:

at least one slat elongated along a central longitudinal axis for weaving between consecutive links in the chain link fence having a predefined cross-sectional width and at least one wall curved at the lateral sides with a first and second longitudinal end, the slat also having a first and second notch each having an upper and lower edge and located on opposite lateral sides directed toward the center longitudinal axis of the slat above the first longitudinal end, the lateral sides of the slat between the first and second notch and the first longitudinal end defining a set of slat ears at the first end; and a rail for weaving between the links of the chain link fence and attaching with the first end of each slat, the rail having a fastening wall, at least one support wall, and at least one retaining section, the fastening wall and the support wall coupled together at the bottom edges by a base section to form a rail channel and the retaining section coupled to the top edge of the fastening wall and slanting downward from the top edge of the fastening wall into the rail channel;

wherein inserting the first end of the slat between the retaining section and the support wall reduces the cross-sectional width of the slat ears and inserting the slat further into the rail channel allows the slat ears to retain their cross-sectional width causing the slat ears to slide underneath the retaining section and automatically seat the retaining section into the first and second notch.

2. The system according to claim 1 wherein the first and second notches each comprise upper edges that slope downward from the lateral side of the slat toward the central axis and meeting with lower edges directed perpendicular to the lateral side of the slat.

3. The system according to claim 1 wherein the slat comprises a single wall having an arched lateral cross-sectional shape.

4. The system according to claim 1 wherein the slat has a given elasticity that allows said slat to be deformed for insertion between the chain links and partially recover from the deformed shape after insertion so that the opposite sides of the slat press outward against the chain links securely holding the slat in the fence, the slat elasticity also allowing recovery of the slat ears into their original cross-sectional width after insertion into the rail channel.

5. The system according to claim 1 wherein the slat comprises a single substantially flat elongate wall with lateral side walls, the lateral side walls sloping in opposite directions upward from opposite lateral edges of the elongate wall away from the slat central longitudinal axis.

6. The system according to claim 1 including a second set of notches residing on opposite lateral sides of the second end of each slat defining a second set of slat ears; and a second rail for weaving between the links in the chain link fence and attaching to the second end of said slat.

7. The system according to claim 1 wherein each slat comprises front and back elongated walls spaced apart by a pair of rounded lateral edges to form a substantially hollow, flat, tubular shape.

8. The system according to claim 7 wherein each notch passes through one of the lateral edges and symmetrically through both the front and back wall.

9. A system for locking plastic slats into a chain link fence, comprising:

elongated slats for weaving between consecutive links in the chain link fence having at least one wall with an arched cross-section capable of being temporarily deformed into a flattened shape and elastically reformed back into the arched configuration, each slat notched on opposite lateral sides near at least one of an associated first and second longitudinal end, the lateral sides of the slat between the notched lateral sides and the associated longitudinal end of the slat defining slat ears with a predefined cross-sectional width; and a rail for weaving between the links of the chain link fence and attaching with the first end of each slat having a fastening wall, at least one support wall, and at least one retaining section each having a top and bottom edge, the fastening wall and the support wall being parallel and coupled together at the bottom edges by a base section to form a channel, the retaining section coupled to the top edge of the fastening wall thereby protruding into the rail channel forming a rail slot;

the rail slot being narrower than the cross-sectional width of the slat ears so that inserting the first end of the slat into the rail slot cause the slat ears to slightly flatten and further inserting the slat into the rail channel allow the slat ears to elastically reform into their original arched shape causing the slat ears to move underneath the retaining section.

10. The system according to claim 9 wherein the support wall is aligned vertically so that upon insertion of slats into said rail substantially the entire support wall presses against the slat holding the slat ears underneath the retaining section.

11. The system according to claim 10 wherein the fastening wall, the support wall and the bottom edge form a rectangular shaped rail channel side profile.

12. The system according to claim 10 wherein the fastening wall conforms with the shape of the slat ears and is coupled at the bottom by a curved base.

13. A method for locking slats into a chain link fence, comprising:

providing elongated slats having a first and second end and at least one wall curved at the lateral sides;

providing a rail having a channel with an upper rail slot for receiving the slats;

cutting notches into the first end of each slat on the opposite lateral sides, the lateral sides of the slat between the notched lateral sides and the first longitudinal end forming curved slat ears at the end of the slat;

weaving the rail between the links in the chain link fence;

weaving the slats between consecutive links in the chain link fence;

inserting the first end of the slat into the rail channel slot flattening the slat ears; and inserting the first end of each slat further into the rail channel allowing the slat ears to elastically reform into their original curved shape.

14. The method according to clam 13 wherein the slates comprise front and back elongated walls spaced apart a given distance by a pair of rounded lateral edges that join the front and back walls together to form a substantially hollow, flattened, tubular shape.

15. The method according to claim 14 wherein the step of inserting the first end of the slat into the rail channel slot press the front and back walls of the slat ears toward each other allowing the slat ears to pass into the rail channel; and the step of inserting the first end of each slat into the rail channel allow the front and back walls of the slat ears to elastically reform into their original spaced apart distance.

* * * * *

UNITED STATES PATENT AND TRADEMARK OFFICE

CERTIFICATE OF CORRECTION

PATENT NO. : 5,465,941
DATED : November 14, 1995
INVENTOR(S) : Joshua B. Abbott

It is certified that error appears in the above-indentified patent and that said Letters Patent is hereby corrected as shown below:

Column 3, line 2, change "fiat" to --flat--;

Column 3, line 11, change "fiat" to --flat--;

Column 6, line 10, change "fiat" to --flat--;

Column 6, line 33, change "fiat" to --flat--;

Column 8, claim 5, line 12, change "fiat" to --flat--;

Column 8, claim 7, line 24, change "fiat" to --flat--.

Signed and Sealed this

Twenty-seventh Day of May, 1997

*Attest:*

Bruce Lehman

BRUCE LEHMAN

*Attesting Officer*

*Commissioner of Patents and Trademarks*